US006079708A

United States Patent [19]

Fujita

[11] Patent Number: 6,079,708

[45] Date of Patent: Jun. 27, 2000

[54] SHEET FEEDING APPARATUS WITH SKEW CORRECTION FOR FED SHEETS

[75] Inventor: Akihiro Fujita, Kanagawa-ken, Japan

[73] Assignee: Ricoh Company, Ltd., Tokyo, Japan

[21] Appl. No.: 09/049,032

[22] Filed: Mar. 27, 1998

[30] Foreign Application Priority Data

Mar. 27, 1997 [JP] Japan ..... 9-075560

[51] Int. Cl.[7] ..... B65H 9/04

[52] U.S. Cl. ..... 271/242; 271/245

[58] Field of Search ..... 271/242, 245; 399/395

[56] References Cited

U.S. PATENT DOCUMENTS 4,826,148 5/1989 Coons, Jr. ..... 271/245
5,022,642 6/1991 Hagesawa et al. ..... 271/10 X
5,648,808 7/1997 Yanagi et al. ..... 347/104 X
5,692,744 12/1997 Funato ..... 271/242

*Primary Examiner*—Christopher P. Ellis
*Assistant Examiner*—Kenneth W. Bower
*Attorney, Agent, or Firm*—Oblon, Spivak, McClelland, Maier & Neustadt, P.C.

[57] ABSTRACT

A sheet feeding apparatus for an image forming device such as a facsimile machine, image scanner, copier, etc. Paper sheets are picked up from a stack of paper sheets and are fed individually to a pair of feeding rollers. In contact with the feeding rollers is an elastic film as a skew correction device. If the paper sheet picked up and fed to the feeding rollers is crumpled or askew such that a leading edge of the picked up paper sheet is not parallel to the feeding roller, the skewed paper sheet contacts the elastic film and the skew in the paper sheet is corrected by the elastic film. As a result, when the paper sheet is fed by the feeding roller, the leading edge of the paper sheet is parallel to the feeding roller and is thereby fed without any skew.

21 Claims, 5 Drawing Sheets

SHEET FEEDING APPARATUS WITH SKEW CORRECTION FOR FED SHEETS

BACKGROUND OF THE INVENTION

1. Field of the Invention

The present invention is directed to a sheet feeding apparatus for use in an image forming device such as a facsimile machine, an image scanner, a copier, or other image forming device which utilizes sheets. More particularly, the present invention is directed to a sheet feeding apparatus which can supply sheets to an image forming device.

2. Discussion of the Background

An image forming device, such as a facsimile machine, an image scanner, a copier. etc., may often include or connect to a sheet feeding unit to feed sheets individually to the image forming device. Such a sheet feeding unit may include a sheet cassette, a pick-up roller and a pair of feeding rollers. The sheet cassette may typically include a bottom board, a spring device for raising the bottom board, a pair of side fences for setting a stack of sheets at a predetermined position, and a separator. The stack of sheets is lifted up by the bottom board and spring device and sheets are fed from the pick-up roller and feeding rollers to the image forming apparatus one by one.

With such a sheet feeding unit, an upper sheet of the stack of sheets is separated by the pick-up roller and the separator and the separated sheet is then transferred to the feeding rollers. However, in such a sheet feeding operation the separated sheet may be transferred to the sheet feeding rollers with a slight skew if, for example, the separated sheet becomes slightly crumpled or crimped, which may result for several reasons, for example if the pick-up position is offset, the pick-up roller is slightly offset or not functioning properly, an obstruction is in the feed path. etc. As a result, if a separated sheet is fed with such a skew, the fed sheet reaches the feeding rollers with the skew, i.e., one leading corner of the fed sheet is slightly ahead of the other leading corner of the fed sheet so that the leading edge of the fed sheet is not parallel to the feeding roller as it reaches the feeding rollers.

As a result of such an offset skew in the feeding of the separated paper sheet, such a fed paper sheet will not be properly printed on or may cause a paper jam.

SUMMARY OF THE INVENTION

Accordingly, one object of the present invention is to provide a novel sheet feeder for use in an image forming device which can ensure proper feeding of paper sheets to the image forming device.

The present invention achieves such an object by correcting for any skew in a leading edge of a fed paper sheet as it reaches feeding rollers in a sheet feeder or the image forming device.

The present invention achieves such a more specific object by including a skew correction device, in one form as an elastic film, positioned at the feeding rollers in the sheet feeder or image forming device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
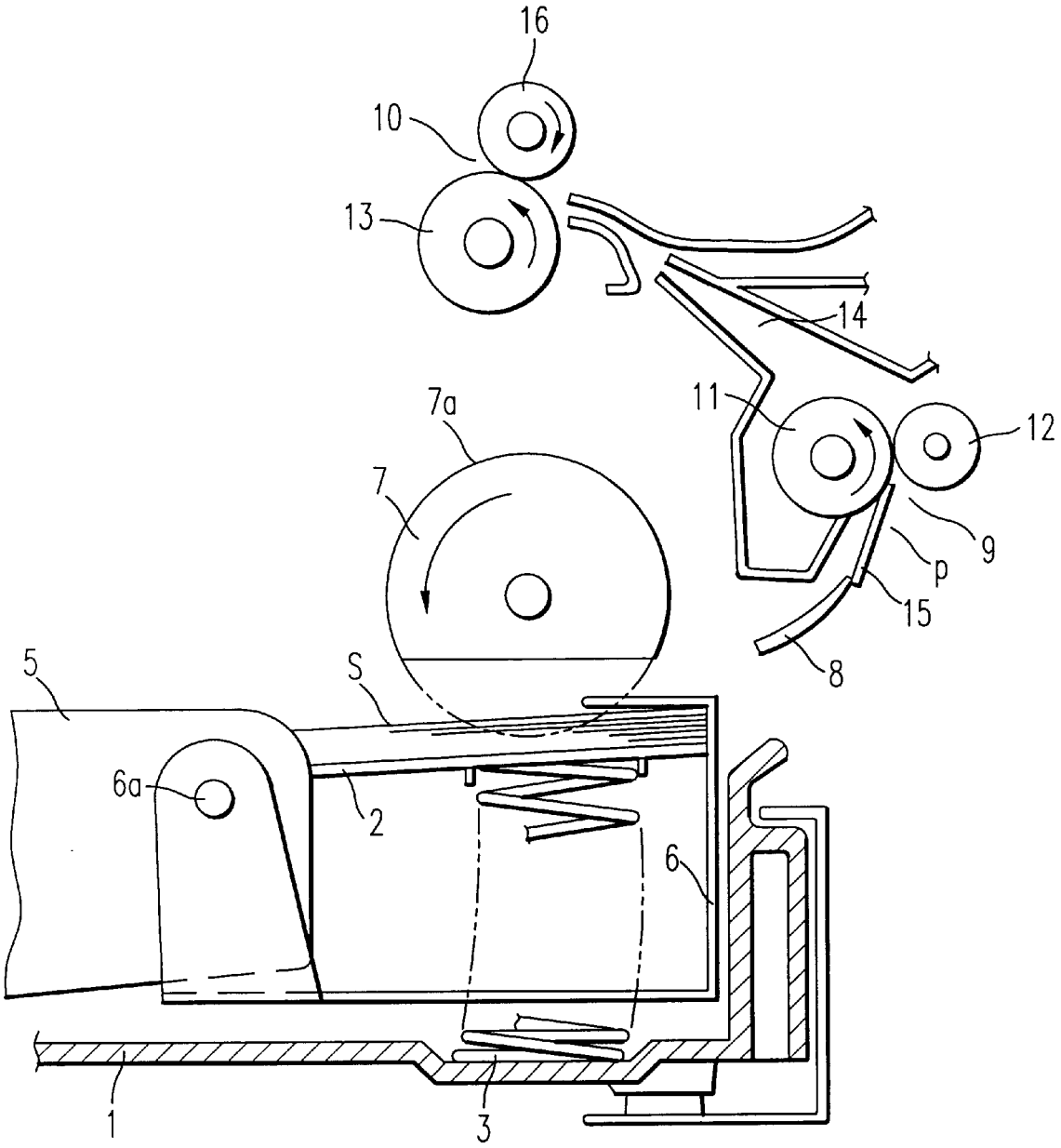
FIG. 1 shows a sectional side view of a sheet feeding unit of an embodiment of the present invention.
Figure 2:
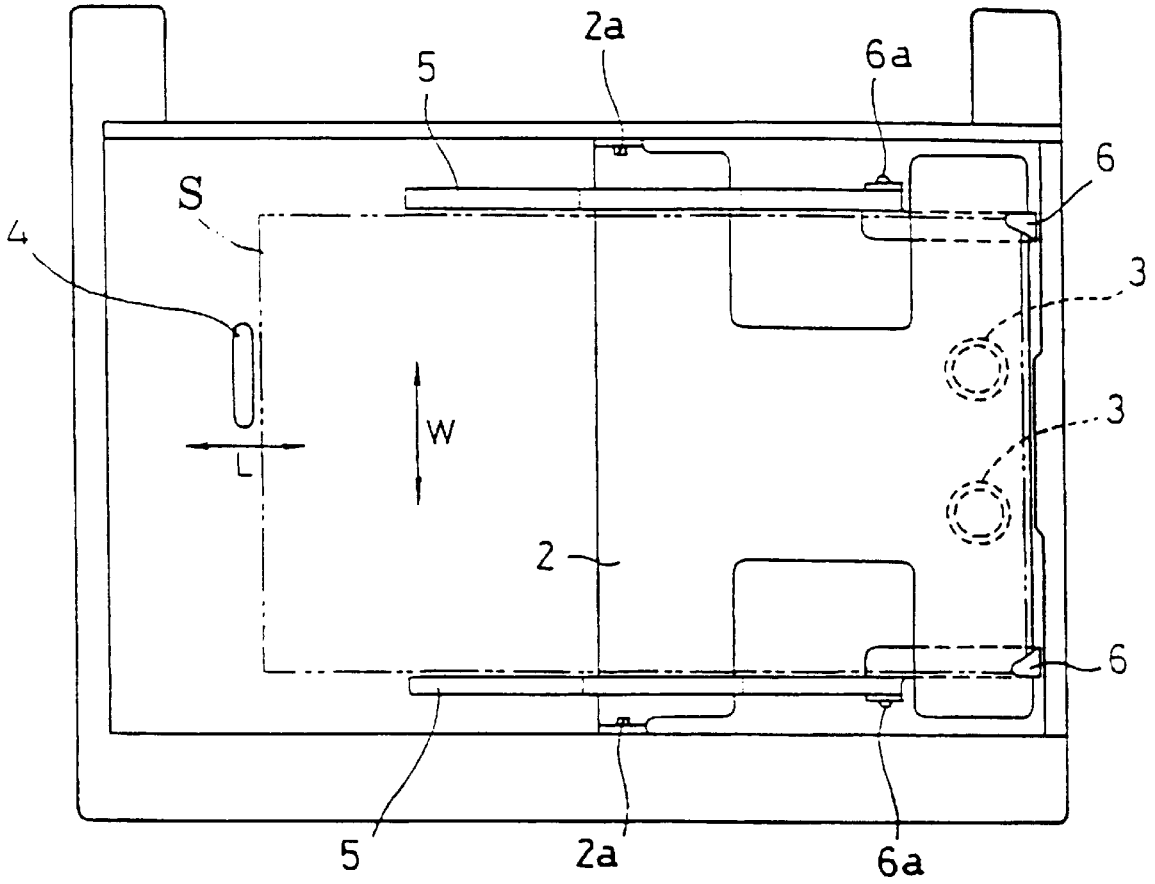
FIG. 2 shows an upper plan view of a sheet cassette utilized in the sheet feeding unit of FIG. 1.

Referring now to the drawings, wherein like reference numerals designate identical or corresponding, parts throughout the several views and more particularly to FIGS. 1 and 2 thereof, a sheet feeding unit to be used with or in an image forming apparatus of an embodiment of the present invention is now described.

The image forming apparatus as shown in FIGS. 1 and 2 includes a sheet cassette 1 which is detachable from a main body of a sheet feeder or an image forming apparatus. A bottom board 2 which swings about a fulcrum shaft 2*a* is positioned at a bottom of the sheet cassette 1. A coil spring 3 is positioned under the bottom board 2 and operates to lift up the bottom board 2. An end fence 4 and a pair of side fences D are positioned in the sheet cassette 1 with movable settings to secure stacks of sheets of different sizes at predetermined positions in the sheet cassette 1. A separating device 6 which swings about a fulcrum shaft 6*a* is also provided.

The sheet feeding or image forming device further includes a pick-up roller 7 with a surface 7*a*, a guide device 8, a pair of feeding rollers 9, including a driver feeding roller 11 and a pressure roller 12, and a sheet guide 14. A skew correction device 15 is also provided between the guide device 8 and the pair of feeding rollers 9. The skew correction device 15 is an elastic film made from a material such as polyethylene terephthalate film and which may have a thickness from 0.2 to 0.3 mm. One edge side of the skew correction device 15 contacts the feeding roller 11 at a laterally extending line position "p" and the other edge side of the skew correction device 15 is fixed to the guide device 8 as shown in FIG. 1. After output from the sheet guide 14, a fed paper sheet is fed to a further pair of rollers 10 including a further feeding roller 13 and pressure roller 16, The guide device 8 can be a solid element or can also take the form of strips of an elastic material, again such as polyethylene terephthalate film.

Figure 3:
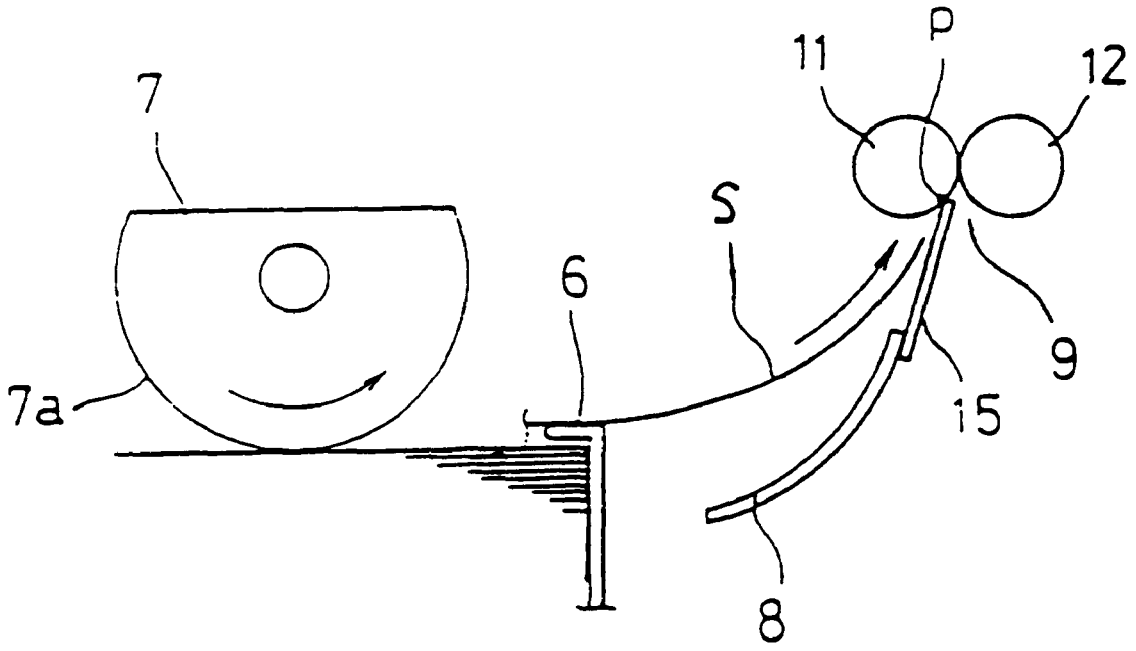
FIG. 3 shows a partly sectional fragmentary view of the sheet feeding unit of FIG. 1.

FIG. 3 shows a sectional fragmentary schematic illustration of the main elements of the sheet feeding device of FIG. 1. As shown in FIG. 3, the sheet feeding device of the present invention operates such that a surface 7*a* of the pick-up roller 7 contacts an upper sheet S of a stack of sheets. The upper sheet S is separated by the separator device 6 and is then fed toward the position "p" and the pair of feeding rollers 9 through the guide device 8 and the skew correction device 15.

As discussed above, and with reference to FIG. 4 as an example, when a paper sheet S is picked up by the pick-up roller 7 and is fed towards the pair of feeding rollers 9, the paper sheet S may become slightly askew or crumpled by the feeding process and develop a crimped or crumpled portion S'. In this situation, a leading edge of the paper sheet S is not parallel to the feeding roller 11 but instead is slightly skewed. When such a crumpled paper sheet S is fed in the device of the present invention, the crumpled sheet S contacts the elastic film skew correction device 15. By virtue of the material of the elastic film skew correction device 15, which as noted above may be polyethylene terephthalate, the skew in the fed paper sheet S is corrected so that at the feeding roller 11 the leading edge of the paper sheet S is parallel to the feeding roller 11 and does not have any skew.

The specific operation in the device of the present invention, and again with reference to FIG. 4 of the present specification as one example, is that as a result of the crimp S' in the paper sheet S, one edge corner of the paper sheet S contacts the skew correction device 15 at the feeding roller 11 (i.e. at position "p") prior to the other edge corner of the paper sheet S reaching position "p" at the feeding roller 11. In the specific example shown in FIG. 4, the left corner edge of the paper sheet S contacts the skew correction device 15 at the feeding roller 11 (i.e.. at position "p") prior to the right corner edge of the paper sheet S contacting the position "p" at the feeding roller 11.

In the device of the present invention the feeding force of the feeding roller 11 depends on a contact condition of the paper sheet S at the feeding roller 11. The skew correction device 15 provides an elastic force to the paper sheet S in an opposite direction to the feeding force on the paper sheet S from the feeding roller 11, and thus this elastic force of the skew correction device 15 counteracts the feeding force of the feeding roller 11.

In a paper sheet feeding operation in the device of the present invention, when the paper sheet S reaches the feeding roller 11 such that the leading edge of the paper sheet S is parallel to the feeding roller 11 (i.e., with no skew or crimp S'), the feeding roller 11 contacts the paper sheet S along an entire leading edge of the paper sheet S at one time. As a result, the feeding force on the paper sheet S from the feeding roller 11 will exceed the counteracting elastic force from the skew correction device 15 on the paper sheet S. Then, the paper sheet S will be fed at the feeding roller 11 at this time that the leading edge of the paper sheet S is parallel to the feeding roller 11. Thereby, the paper sheet S is properly fed without any skew.

Figure 4:
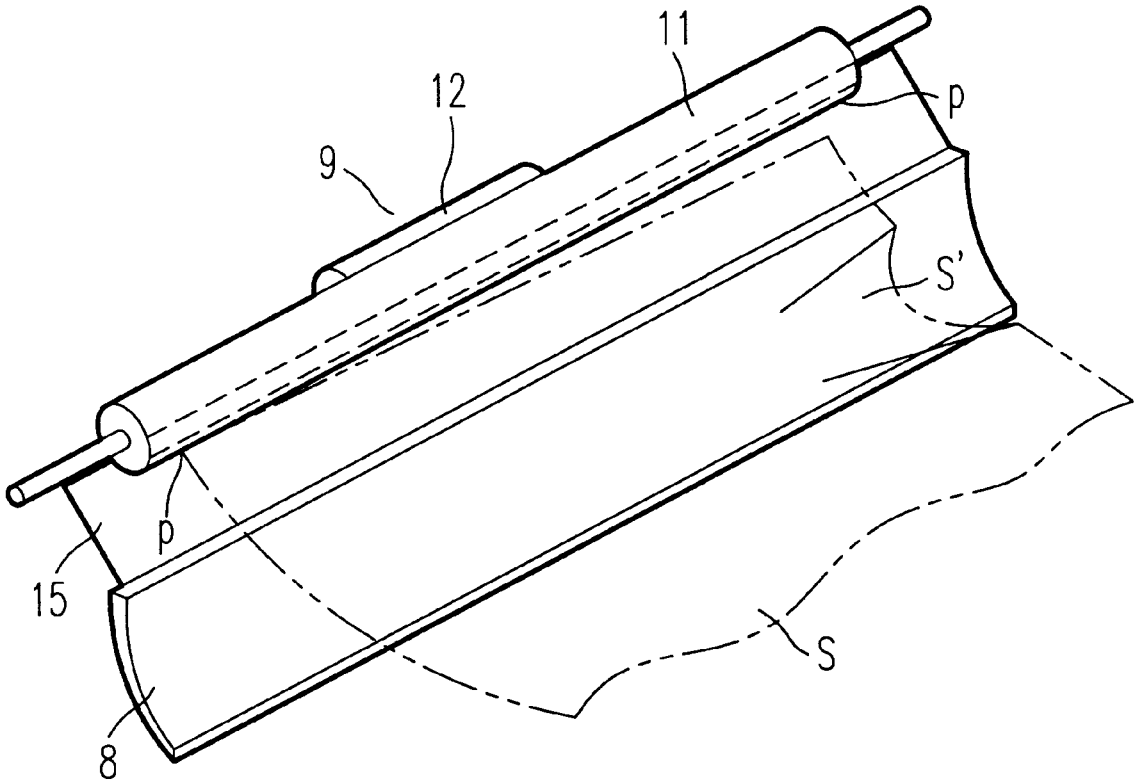
FIG. 4 shows a further fragmentary view of the sheet feeding unit of FIG. 1.

However, if the paper sheet S has a skew or has been crumpled with a crimp S' and the leading edge of the paper sheet S is thereby skewed, only one edge corner of the leading edge of the paper sheet S' initially reaches the contact position "p" between the feeding roller 11 and the skew correction device 15. In the example shown in FIG. 4, the left leading edge corner of the paper sheet S reaches the contact position "p" between the feeding roller 11 and the skew correction device 15 prior to the right leading edge corner of the paper sheet S reaching the position "p". In this instance, the skew correction device 15 provides an elastic force against the paper sheet S which exceeds the feeding force of the feeding roller 11 as the feeding roller 11 only contacts a small portion of the leading edge of the paper sheet S; and as a result, at this time the paper sheet S is not fed by the feeding roller I and movement of the left leading edge corner of the paper sheet S is retarded and remains at the position "p". At this time, the pick-up roller 7 continues to feed the paper sheet S so that the other leading edge corner of the paper sheet S, for example the right leading edge corner as shown in the example of FIG. 4, is still moved towards the position "p" where the feeding roller 11 contacts the skew correction device 15. When this other leading edge corner of the paper sheet S reaches the position "p" where the feeding roller 11 contacts the skew correction device 15 (at which time the skew will be eliminated), then the feeding roller 11 will contact the entire leading edge portion of the paper sheet S. At this time, since the feeding roller contacts the paper sheet S along its entire leading edge, the feeding force imparted by the feeding roller 11 onto the paper sheet S overcomes the opposite elastic force of the skew correction device 15, and the paper sheet S is then fed by the feeding roller 11 without any skew.

In this way, the elastic nature of the skew correction device 15 can ensure that paper sheets S are only fed by the feeding roller 11 when the entire leading edge of the paper sheet S reaches the parallel line position "p" and that thus there is no skew in the paper sheet S. As a result, the paper sheet S is fed without any skew and an image formed on the paper sheet S can be properly formed, and the paper sheet S will not cause any paper jammings by nature of its being crumpled.

The embodiment of FIG. 4 shows utilizing one long feeding roller 11. In this embodiment as shown in FIG. 4, the length of the feeding roller 11 must be larger than that of a width of the various paper sheets S to properly correct for any skew in such paper sheets S. As a result, a long feeding roller 11 is required, and thus the feeding roller 11 may be a high cost element.

Figure 5:
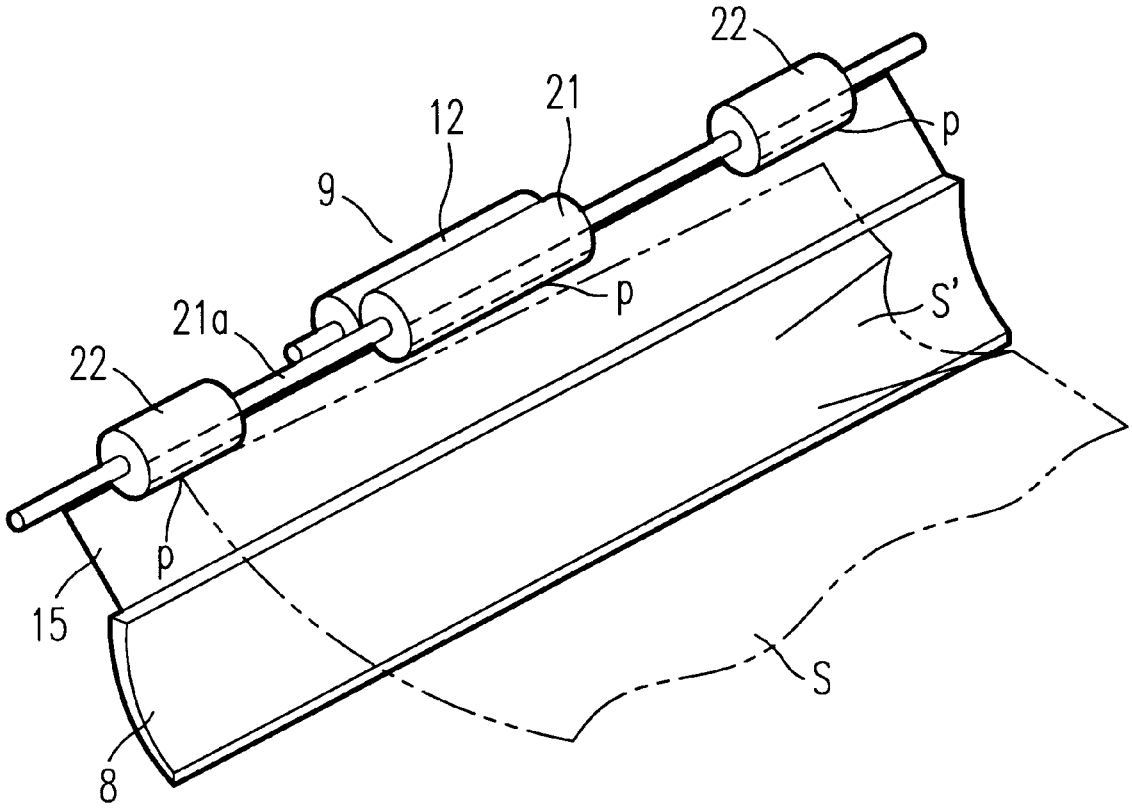
FIG. 5 shows a perspective view of a pair of feeding rollers and a sheet feeding unit in a further embodiment of the present invention.

A further embodiment of the present invention is shown in FIG. 5 which eliminates the requirements of one long feeding roller 11. In this further embodiment of the present invention as shown in FIG. 5, the long feeding roller 11 is replaced with plural feeding rollers 21, 22 which overall may be smaller in size and which may be cheaper to manufacture than the one long feeding roller 11. Thus, this further embodiment of FIG. 5 may reduce the cost of an image forming device.

It should also be specifically noted that the device of the present invention can be utilized with both a front loading sheet feeding device and a side loading sheet feeding device, as well as other types of sheet feeding devices. A front loading sheet feeding device feeds paper sheets parallel to a direction of sheet transport after feeding, and a side loading sheet feeding device feeds paper sheets perpendicular to a direction of sheet transport after feeding.

The applicant of the present invention has also conducted tests to compare, for both front and side loading devices, the effect of including the skew correction device 15 in a copy machine as an example of an image forming device. The following Table 1 compares for both front and side loading copying devices a system which includes only a center feed roller 11, i.e., without the skew correction device 15, a system of the present invention with the skew correction device 15 and a difference between the two systems for sheet copying operations of 10, 250 and 500 sheets for 3 tests (note in Table 1 that some values are rounded out). As is evident from Table 1, the present invention provides advantages in both a front loading and side loading copying device in decreasing the amount of skew of fed paper sheets.

TABLE 1

| Paper Size | Amount of Skew (in mm) | | | | | | | | | | | |
|---|---|---|---|---|---|---|---|---|---|---|---|---|
| T = Front Loading | 10 sheets | | | | 250 sheets | | | | 500 sheets | | | |
| Tests | 1 | 2 | 3 | Average for the 3 tests | 1 | 2 | 3 | Average for the 3 tests | 1 | 2 | 3 | Average for the 3 tests |
| T:A4 With center feed roller only | 0.3 | 0.35 | 0.2 | 0.28 | 0.55 | 0.5 | 0.6 | 0.55 | 0.95 | 0.75 | 0.65 | 0.78 |
| T:A4 With skew correction device 15 of present invention | 0.2 | 0.25 | 0.25 | 0.23 | 0.3 | 0.25 | 0.2 | 0.25 | 0.35 | 0.15 | 0.2 | 0.23 |
| T:A4 Difference | 0.1 | 0.1 | −0.1 | 0.05 | 0.25 | 0.25 | 0.4 | 0.3 | 0.6 | 0.6 | 0.45 | 0.55 |
| T:B4 With center feed roller only | 0.3 | 0.3 | 0.15 | 0.25 | 0.1 | 0.1 | 0 | 0.07 | | 0.05 | 0.15 | 0.07 |
| T:B4 With skew correction device 15 of present invention | 0.1 | 0.05 | 0.05 | 0.07 | 0.1 | 0.05 | 0.15 | 0.1 | 0 | 0 | 0.1 | 0.03 |
| T:B4 Difference | 0.2 | 0.25 | 0.1 | 0.18 | 0 | 0.05 | −0.2 | −0 | 0 | 0.05 | 0.05 | 0.03 |
| Y = Side Loading | | | | | | | | | | | | |
| Y:A4 With center feed roller only | 0.55 | 0.6 | 0.5 | 0.55 | 0.8 | 0.85 | 0.95 | 0.87 | 1.5 | 1.3 | 1.25 | 1.35 |
| Y:A4 With skew correction device 15 of present invention | 0.1 | 0.05 | 0.25 | 0.13 | 0.05 | 0.35 | 0.15 | 0.18 | 0.1 | 0.3 | 0.3 | 0.23 |
| Y:A4 Difference | 0.45 | 0.55 | 0.25 | 0.42 | 0.75 | 0.5 | 0.8 | 0.68 | 1.4 | 1 | 0.95 | 1.12 |
| Y:B4 With center feed roller only | 0.3 | 0.55 | 0.35 | 0.4 | 0.7 | 0.8 | 0.4 | 0.63 | 1.4 | 1.4 | 1.15 | 1.32 |
| Y:B4 With skew correction device 15 of present invention | 0.15 | 0.15 | 0.1 | 0.13 | 0.55 | 0.55 | 0.55 | 0.55 | 0.75 | 0.75 | 0.9 | 0.8 |
| Y:B4 Difference | 0.15 | 0.4 | 0.25 | 0.27 | 0.15 | 0.25 | −0.2 | 0.08 | 0.65 | 0.65 | 0.25 | 0.52 |

Obviously numerous additional modifications and variations of the present invention are possible in light of the above teachings. It is therefore to be understood that within the scope of the appended claims, the present invention may be practiced otherwise than as specifically described herein.

The present application is based on Japanese priority document 9-075560, the contents of which are incorporated herein by reference.

What is claimed is:

1. A sheet feeding apparatus, comprising:

a first roller;

a skew correcting member having a surface disposed next to the first roller at a position upstream, of a travel direction of the sheet, of where the first roller and another roller form a nip, and which is urged towards the first roller so as to retard a movement of a sheet that is passed between said skew correcting member and said first roller;

a second roller which separates the sheet from a stack of sheets and transmits the sheet between the first roller and the surface of the skew correcting member in order to straighten a skew of the sheet prior to the sheet being nipped;

wherein the skew correcting member being an elastic material.

2. The sheet feeding apparatus according to claim 1, wherein the skew correcting member contacts the first roller.

3. The sheet feeding apparatus according to claim 1, further comprising said another roller as a third roller which contacts the first roller at a position downstream of the skew correcting member relative to a travel direction of the sheet.

4. The sheet feeding apparatus according to claim 1, wherein the first roller is a single roller.

5. The sheet feeding apparatus according to claim 1, wherein the first roller comprises a plurality of individual rollers.

6. The sheet feeding apparatus according to claim 1, wherein the elastic material is an elastic film.

7. The sheet feeding apparatus according to claim 6, wherein the elastic film comprises a polyethylene terephthalate film with a thickness from 0.2 mm to 0.3 mm.

8. A sheet feeding apparatus, comprising;

a first driven roller;

a skew correcting member having a surface disposed next to said first driven roller;

wherein the skew correcting member being an elastic material, and when a first edge of a sheet reaches a position between the first driven roller and the surface of the skew correcting member before a second edge of the sheet reaches the position between the first driven roller and the surface of the skew correcting member, movement of the first edge of the sheet is retarded relative to the second edge of the sheet to correct a skew of the sheet while said driven roller is rotating.

9. The sheet feeding apparatus according to claim 8, wherein the skew correcting member contacts the first driven roller.

10. The sheet feeding apparatus according to claim 8, further comprising a second roller which contacts the first driven roller at a position downstream of the skew correcting member relative to a travel direction of the sheet.

11. The sheet feeding apparatus according to claim 8, wherein the first driven roller is a single roller.

12. The sheet feeding apparatus according to claim 8, wherein the first driven roller comprises a plurality of individual rollers.

13. The sheet feeding apparatus according to claim 8, wherein the elastic material is an elastic film.

14. The sheet feeding apparatus according to claim 9, wherein the elastic film comprises a polyethylene terephthalate film with a thickness from 0.2 mm to 0.3 mm.

15. A sheet feeding apparatus, comprising:

pick-up means for picking up a paper sheet from a stack of paper sheets and transporting the picked up paper sheet in a predetermined direction to a feeding roller means; and correcting means for correcting a skew of the picked up paper sheet at the feeding roller means while said feeding roller means is in motion, said correcting means including means for retarding a movement of the sheet in the predetermined direction, wherein the correcting means comprises an elastic material.

16. The sheet feeding apparatus according to claim 15, wherein the correcting means contacts the feeding roller means.

17. The sheet feeding apparatus according to claim 15, further comprising a second roller means which contacts the feeding roller means at a position downstream of the correcting means relative to a travel direction of the sheet.

18. The sheet feeding apparatus according to claim 15, wherein the feeding roller means comprises a single roller.

19. The sheet feeding apparatus according to claim 15, wherein the feeding roller means comprises a plurality of individual rollers.

20. The sheet feeding apparatus according to claim 15, wherein the elastic material comprises an elastic film.

21. The sheet feeding apparatus according to claim 20, wherein the elastic film comprises a polyethylene terephthalate film with a thickness from 0.2 mm to 0.3 mm.

* * * * *

UNITED STATES PATENT AND TRADEMARK OFFICE

CERTIFICATE OF CORRECTION

PATENT NO. : 6,079,708

DATED : June 27, 2000

INVENTOR(S): Akihiro FUJITA

It is certified that an error appears in the above-identified patent and that said Letters Patent is hereby corrected as shown below:

Column 2, Line 30, change "fences D" to --fences 5--;

Column 2, Line 50, change "16," to --16.--.

Column 3, Line 59, change "roller I" to --roller 11--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*